US010774831B2

(12) United States Patent
Jones

(10) Patent No.: US 10,774,831 B2
(45) Date of Patent: Sep. 15, 2020

(54) METHOD FOR IMPREGNATING THE STATOR OF A PROGRESSIVE CAVITY ASSEMBLY WITH NANOPARTICLES

(71) Applicant: Tenax Energy Solutions, LLC, Clinton, OK (US)

(72) Inventor: Kevin Dewayne Jones, Clinton, OK (US)

(73) Assignee: Tenax Energy Solutions, LLC, Clinton, OK (US)

( * ) Notice: Subject to any disclaimer, the term of this patent is extended or adjusted under 35 U.S.C. 154(b) by 186 days.

(21) Appl. No.: 15/976,194

(22) Filed: May 10, 2018

(65) Prior Publication Data

US 2018/0328359 A1 Nov. 15, 2018

Related U.S. Application Data

(60) Provisional application No. 62/504,662, filed on May 11, 2017.

(51) Int. Cl.

| | |
|---|---|
| ***F04C 2/107*** | (2006.01) |
| ***E21B 4/02*** | (2006.01) |
| ***C23C 24/02*** | (2006.01) |
| ***C23C 24/00*** | (2006.01) |
| ***C23C 26/00*** | (2006.01) |
| ***F04C 13/00*** | (2006.01) |

(52) U.S. Cl.

CPC ..... *F04C 2/1075* (2013.01); *C23C 24/00* (2013.01); *C23C 24/02* (2013.01); *C23C 26/00* (2013.01); *E21B 4/02* (2013.01); *F04C 13/008* (2013.01); *F04C 2230/91* (2013.01); *F04C 2240/10* (2013.01); *F04C 2240/20* (2013.01); *F04C 2250/20* (2013.01); *F04C 2250/30* (2013.01); *F05C 2203/0856* (2013.01); *F05C 2253/12* (2013.01)

(58) Field of Classification Search

CPC ..... F04C 2/1075

See application file for complete search history.

(56) References Cited

U.S. PATENT DOCUMENTS

| | | | | |
|---|---|---|---|---|
| 2,449,510 A * | 9/1948 | Robertson | C10M 7/00 | 508/166 |
| 3,234,129 A * | 2/1966 | Perilstein | C10M 1/08 | 508/378 |
| 3,453,208 A * | 7/1969 | Walters | C08L 81/02 | 508/106 |
| 3,730,893 A * | 5/1973 | Bilow et al. | C08G 61/10 | 508/100 |
| 3,756,982 A * | 9/1973 | Korshak et al. | C08L 65/02 | 508/124 |

(Continued)

*Primary Examiner* — Jason L Vaughan

(74) *Attorney, Agent, or Firm* — Tomlinson McKinstry, P.C.

(57) ABSTRACT

A method for impregnating a stator of a progressive cavity assembly with nanoparticles. The assembly comprising a stator having an inner core formed on its inner surface, the inner core defining a groove. A primary rotor is disposed within the groove. In operation, the primary rotor is removed from the stator, and a plurality of nanoparticles are distributed throughout the groove. A work rotor is installed within the groove and rotated at a high rate so as to press the nanoparticles into the inner core. The work rotor is removed from the stator and the primary rotor is re-installed into the stator.

15 Claims, 7 Drawing Sheets

(56) References Cited

U.S. PATENT DOCUMENTS

| | | | | |
|---|---|---|---|---|
| 5,759,019 | A | 6/1998 | Wood et al. | |
| 6,543,132 | B1 | 4/2003 | Krueger et al. | |
| 6,977,096 | B2 * | 12/2005 | LeClaire | C23C 4/02 427/180 |
| 7,918,274 | B2 * | 4/2011 | Thornton | E21B 17/1085 166/241.2 |
| 9,228,584 | B2 | 1/2016 | Akbari et al. | |
| 9,605,677 | B2 * | 3/2017 | Heidecker | F04C 15/0003 |
| 2006/0216178 | A1 | 9/2006 | Sindt et al. | |
| 2009/0152009 | A1 | 6/2009 | Slay et al. | |
| 2012/0292043 | A1 * | 11/2012 | Thornton | E21B 17/1078 166/369 |
| 2017/0111997 | A1 * | 4/2017 | Matsuyama | B26F 1/16 |

* cited by examiner

METHOD FOR IMPREGNATING THE STATOR OF A PROGRESSIVE CAVITY ASSEMBLY WITH NANOPARTICLES

SUMMARY

The present invention is directed to a method comprising the steps of providing a stator comprising an inner surface and an inner core formed on the inner surface and defining a groove, and distributing a plurality of nanoparticles within the groove.

The present invention is also directed to a method of treating a tubular stator having an internal elastomeric substrate within which at least one helical groove is formed. The method comprises the steps of distributing nanoparticles within the at least one groove, and coating the at least one groove by pressing the distributed nanoparticles into the substrate.

DETAILED DESCRIPTION

Figure 1:
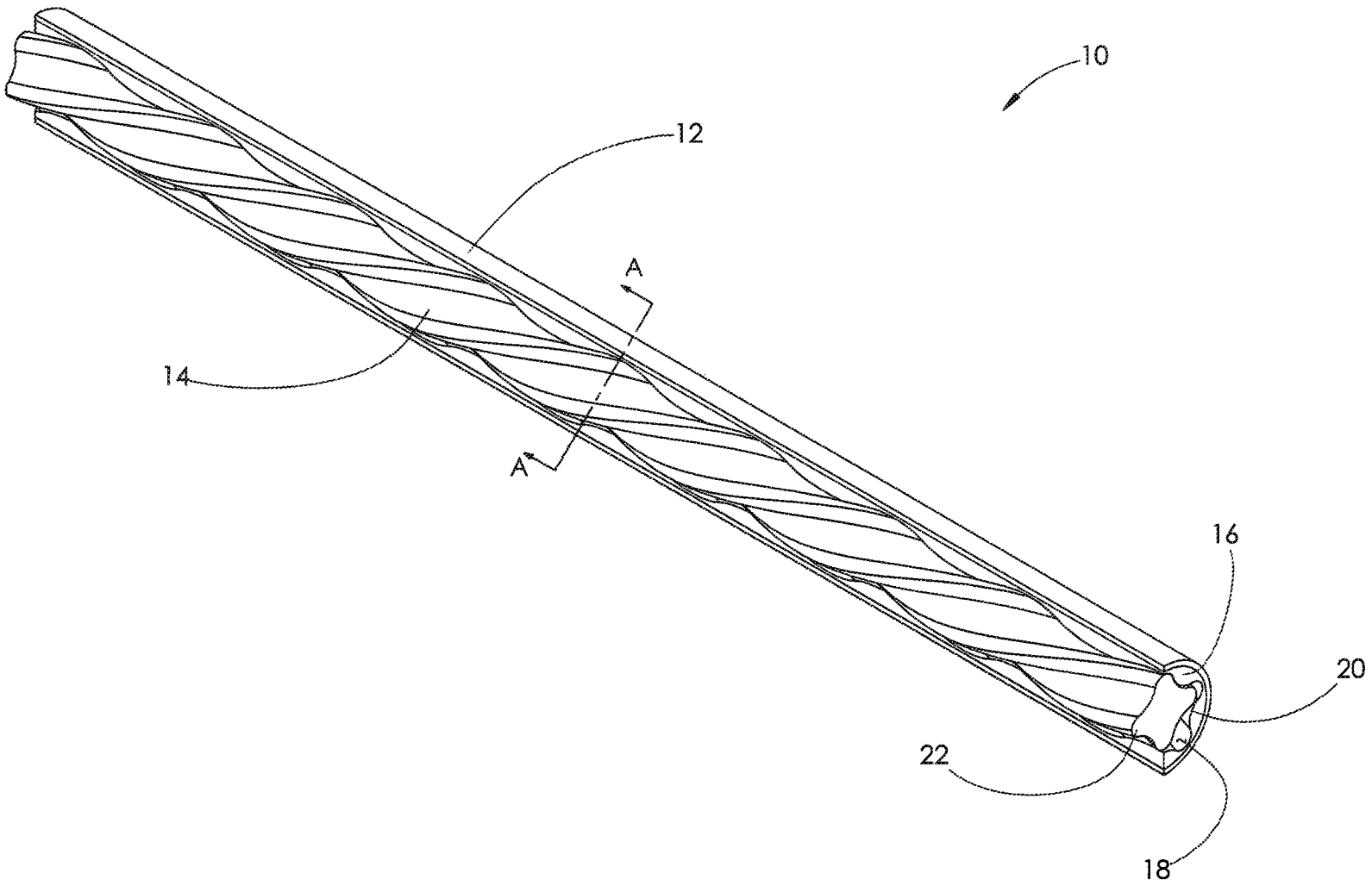
FIG. 1 PRIOR ART
FIG. 1 is a perspective view of a progressive cavity assembly known in the art. A portion of the stator of the assembly has been cut away to better show the rotor.

With reference to FIG. 1, a progressive cavity assembly 10 or mud motor known in the art is shown. The assembly 10 may be used downhole in underground drilling operations, particularly in oil and gas drilling operations. The assembly 10 is typically used to provide power to a drill bit connected to the assembly (not shown) while drilling. The assembly 10 comprises an elongate outer stator 12 and an elongate inner rotor 14. A seal or inner core 16 is formed on the inner surface of the stator 12. The inner core 16 defines a groove 18 within the stator 12. The rotor 14 is positioned within the groove 18.

Figure 2:
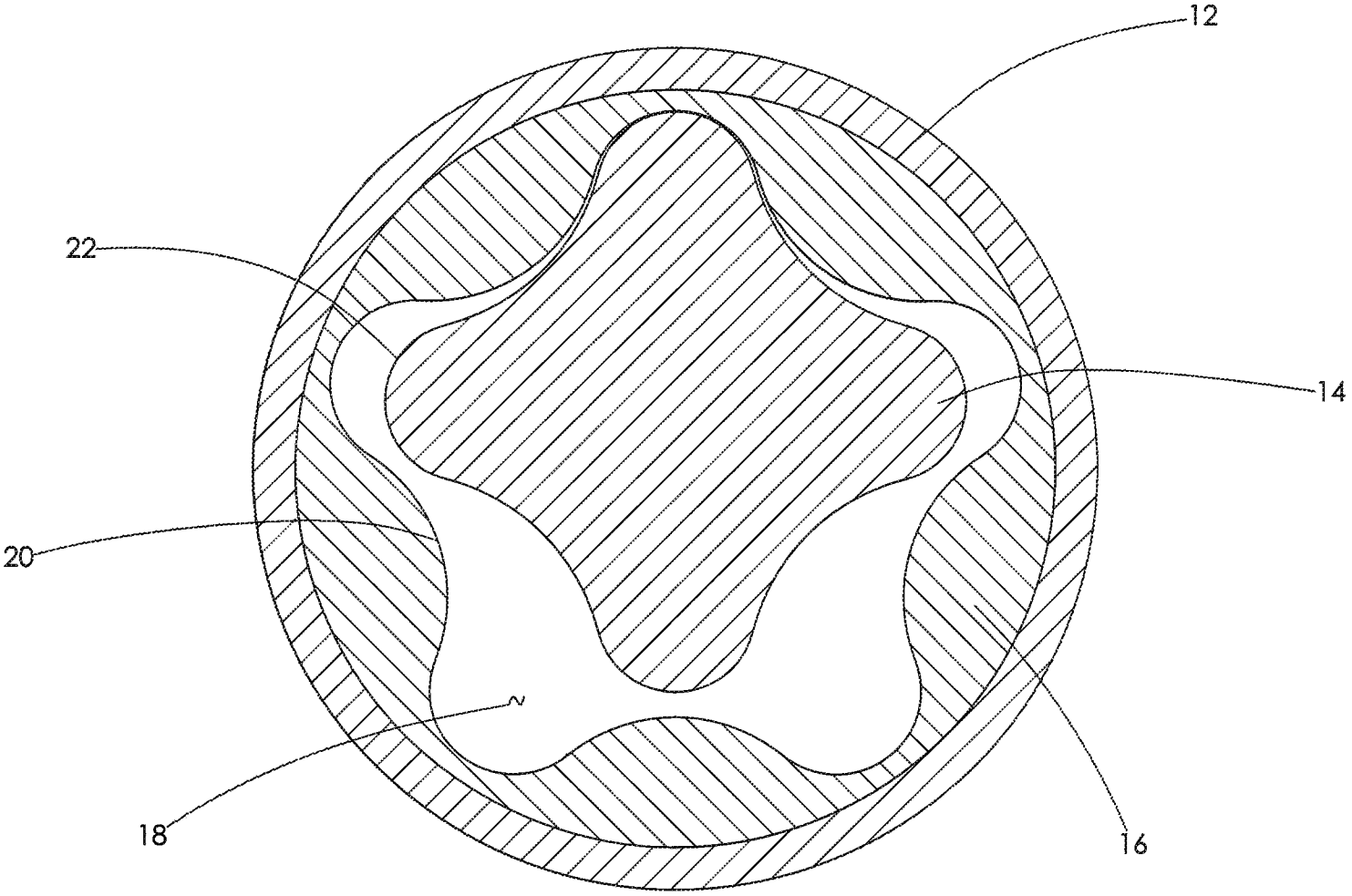
FIG. 2 PRIOR ART
FIG. 2 is a cross-sectional view of the assembly shown in FIG. 1 taken along line A-A.

With reference to FIGS. 1-2, the groove 18 formed by the inner core 16 may be characterized by a plurality of helical lobes 20. A plurality of helical lobes 22 are also formed on an outer surface of the rotor 14. As shown in FIGS. 1-2, the inner core 16 has five lobes 20, and the rotor 14 has four lobes 22. Because the stator 12 has more lobes than the rotor 14, the rotor will rotate eccentrically within the stator. The eccentric motion of the rotor 14 is transferred as concentric power to the drill bit.

The inner core 16 of the stator 12 may have fewer than five lobes or greater than five lobes, if desired. Likewise, the rotor 14 may have fewer than four lobes or greater than four lobes, if desired. The rotor 14 typically has one less lobe than the inner core 16 of the stator 12. Increasing the number of lobes 20, 22 on both the inner core 16 and the rotor 14 typically increases the horsepower created by the assembly 10.

During operation, drilling fluid is used to rotate the rotor 14 within the stator 12. The inner core 16 may be made of rubber or a polymer material to help maintain drilling fluid within the assembly 10 during operation. The stator 12 and rotor 14 are typically made of metal or steel. The rotor 14 engages with the inner core 16 as it rotates, causing friction during operation. The friction may decrease the power and efficiency of the assembly 10 and cause the assembly 10 overheat.

The present invention is directed to a method for reducing friction within the assembly 10. Friction may be reduced within the assembly 10 by impregnating a plurality of nanoparticles 24, shown in FIGS. 5-7, into a surface layer of the inner core 16 of the stator 12. The nanoparticles 24 exfoliate the outer surface of the rotor 14 as it rotates. The exfoliation of the rotor 14 reduces friction within the assembly 10 during operation. The exfoliation is done at a microscopic level so as to not affect the integrity of the rotor 14.

The nanoparticles 24 may be formed from different substances capable of reducing friction within the assembly 10. Preferably, the nanoparticles 24 are made from tungsten disulfide ($WS_2$). The nanoparticles 24 may be of any size or shape desired. Preferably, the nanoparticles 24 are asymmetrical in shape and have a maximum dimension of less than 0.06 nm.

Figure 3:
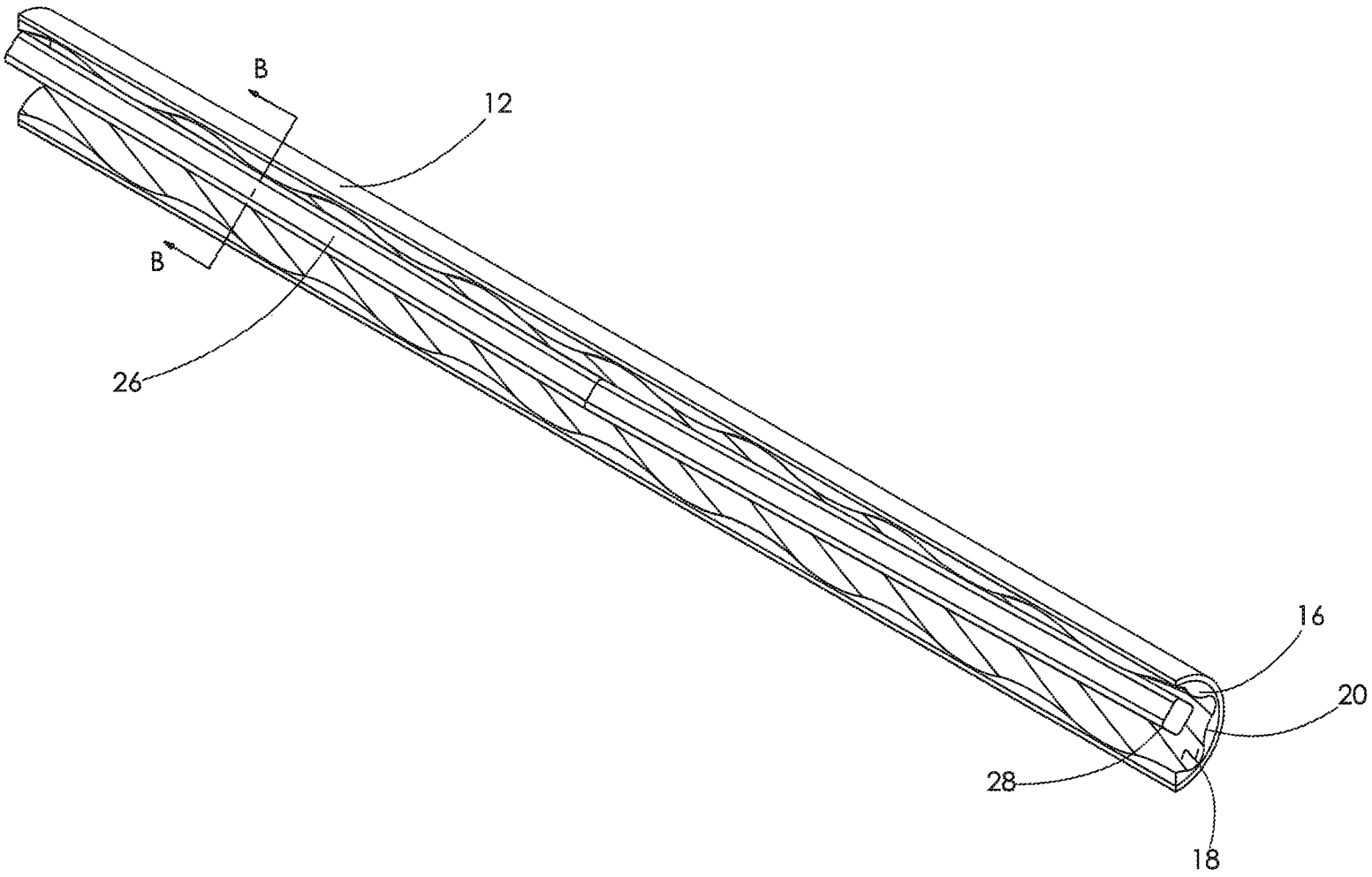
FIG. 3 is a perspective view of the stator shown in FIG. 1. The rotor shown in FIG. 1 has been removed and replaced with a work rotor. A portion of the stator has been cut away to better show the work rotor.
Figure 4:
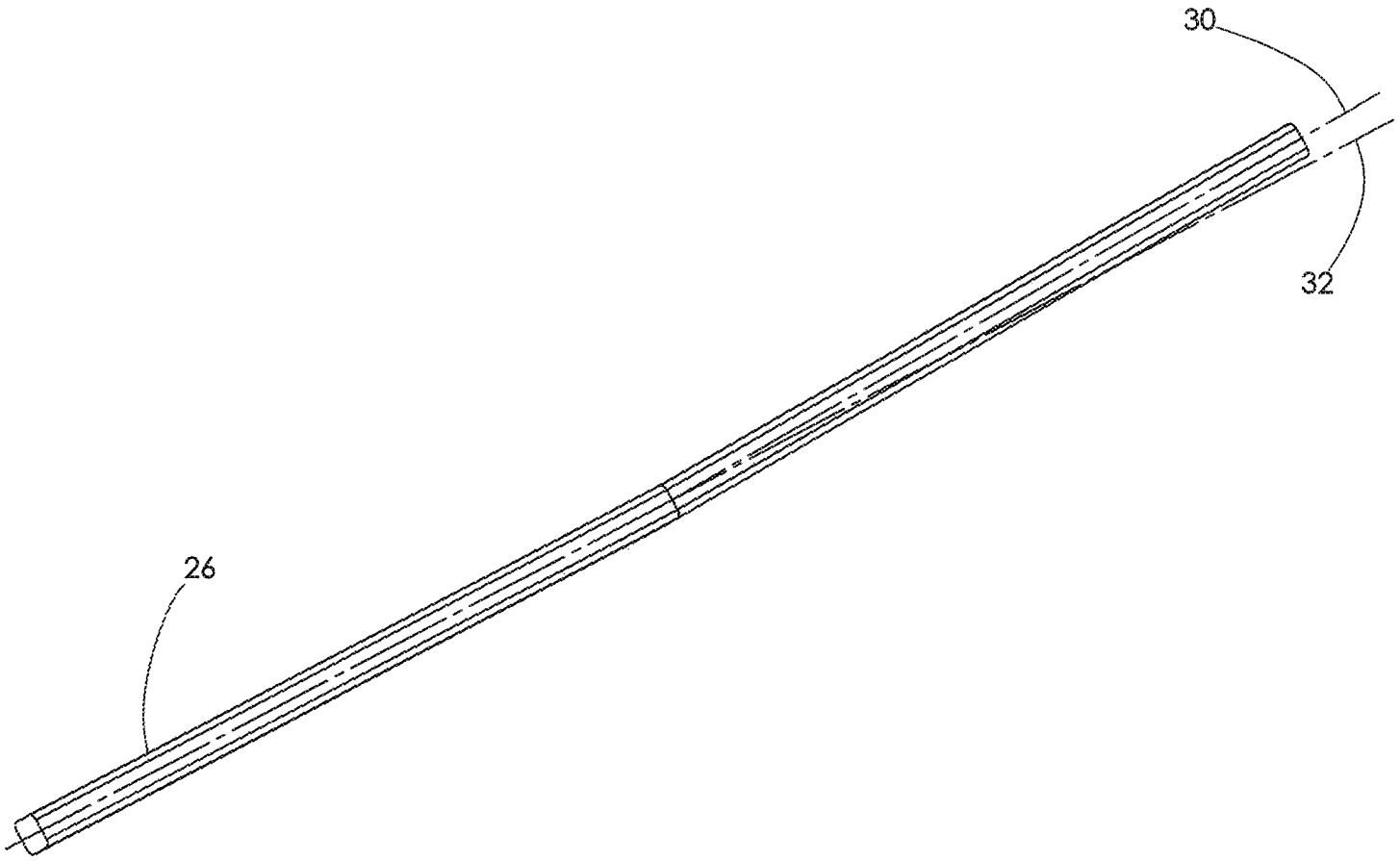
FIG. 4 is a perspective view of the work rotor shown in FIG. 3.
Figure 5:
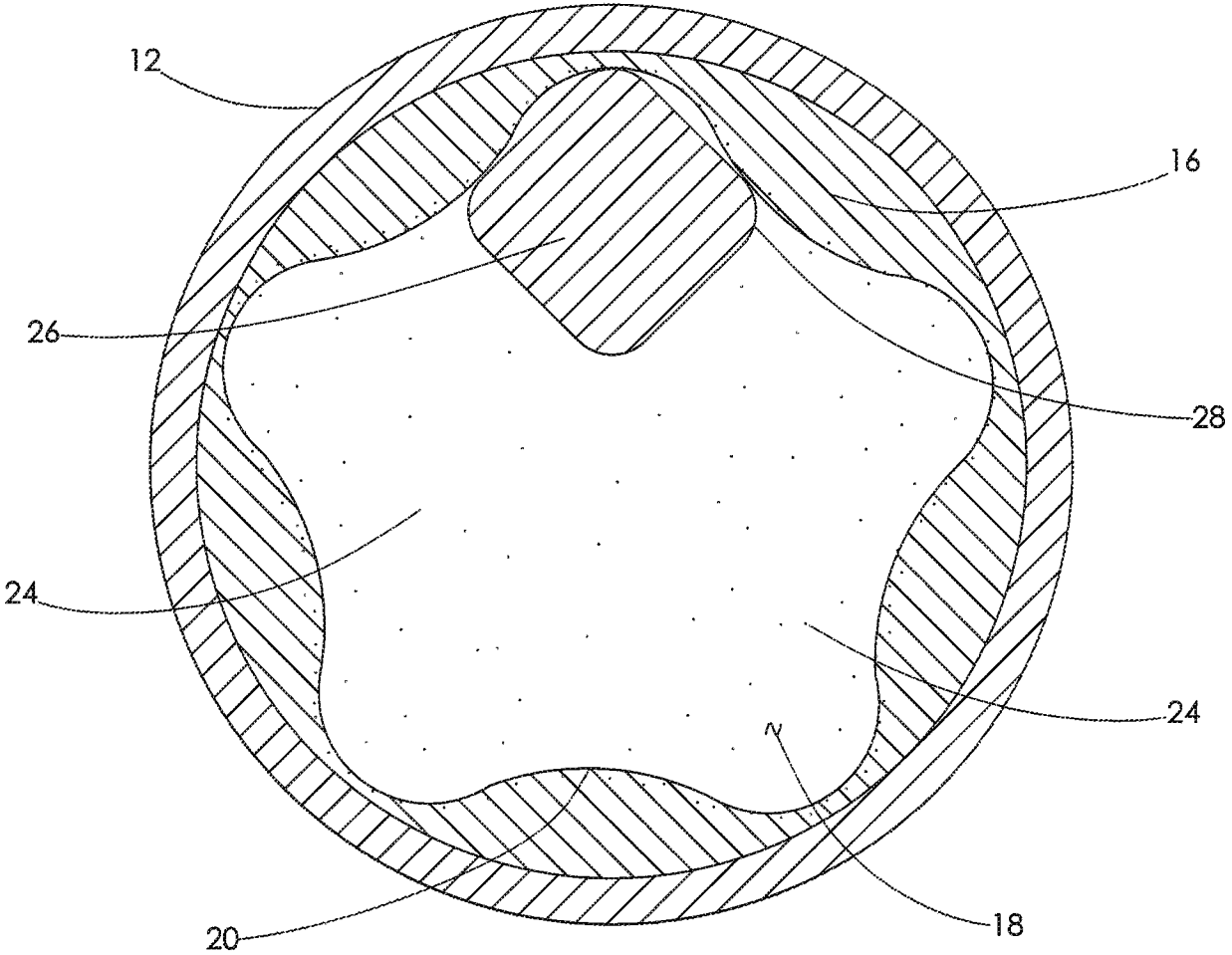
FIG. 5 is a cross-sectional view of the assembly shown in FIG. 3 taken along line B-B. A plurality of nanoparticles are shown distributed throughout a groove formed in the inner surface of the stator.

With reference to FIGS. 3-7, a process for impregnating or coating the inner core 16 of the stator 12 with nanoparticles 24 is described. To start, the original or primary rotor 14 is first removed from the stator 12. The stator 12 may be heated to a temperature between 120° F. to 150° F. Heating the stator 12 softens the inner core 16 making it more pliable. The plurality of nanoparticles 24 are then distributed uniformly throughout the groove 18 formed by the inner core 16, as shown in FIG. 5. An elongate secondary or work rotor 26 is then installed into the stator 12, as shown in FIGS. 3 and 5.

Figure 6:
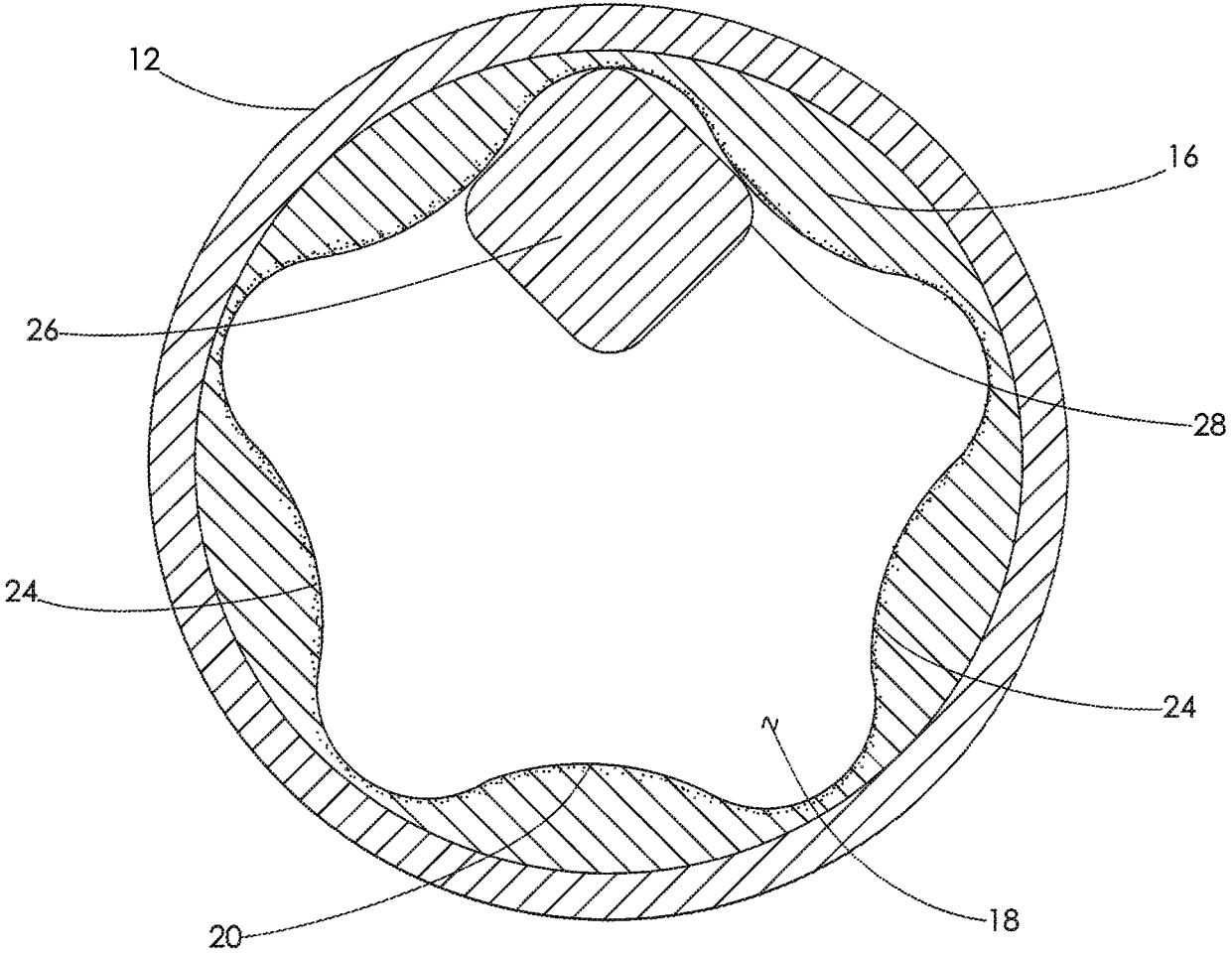
FIG. 6 is the same view shown in FIG. 5. The plurality of nanoparticles are shown impregnated within the inner core of the stator.

After the work rotor 26 is installed in the stator 12, it is rotated at a high rate of speed within the stator 12 using a rotatory impact device, such as a power drill. The work rotor 26 operates to press the nanoparticles 24 into a surface layer of the inner core 16 as it rotates, as shown in FIG. 6. The rate of rotation of the work rotor 26 may vary as needed throughout the process in order to effectively press the nanoparticles 24 into the inner core 16. For example, the rate or rotation may vary from 200 rpm to 2000 rpm. It may take several minutes or several hours, depending on the size and shape of the stator 12, to effectively press all or almost all of the nanoparticles into the surface layer of the inner core 16.

The work rotor 26 is preferably made of metal or steel and has a square cross-sectional shape, as shown in FIGS. 3 and 5. The work rotor 26 preferably has radius or rounded corners 28. Preferably, the corners have a ¼ inch radius. Alternatively, the work rotor 26 may be configured to different shapes and sizes, as desired, such a diamond or star cross-sectional shape.

Regardless of how the work rotor 26 is shaped, it preferably has a smaller width than the primary rotor 14. The work rotor 26 needs to be small enough that it can effectively fit between each lobe 20 of the stator. The work rotor 26 may also be bent along its length, as shown in FIG. 4. The bend provides the work rotor 26 with more torque as it rotates within the stator 12. FIG. 4 shows a centerline 30 of the work rotor 26 as compared a straight reference line 32, in order to display the bend. The bend is small enough so that the work rotor 26 still fits within the groove 18 of the stator 12. For example, the bend may offset the centerline 30 by about 3 degrees.

Figure 7:
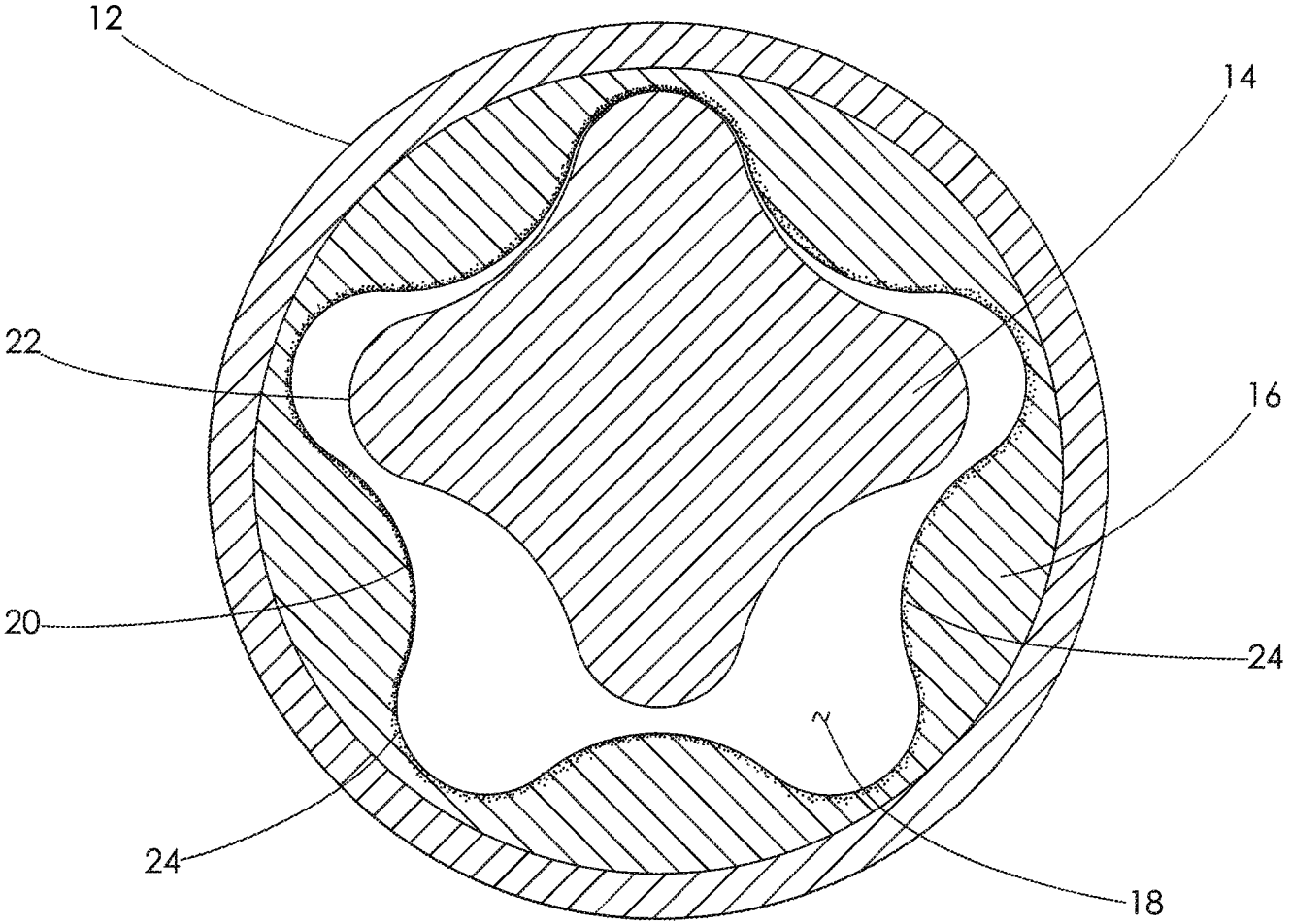
FIG. 7 is the same view as FIG. 2. The plurality of nanoparticles are shown impregnated within the inner core of the stator.

After the inner core 16 is coated with nanoparticles 24, the work rotor 26 is removed from the stator 12. The original or primary rotor 14 may then be re-installed into the stator 12, as shown in FIG. 7. The inner core 16 holds the nanoparticles 24 in place so that they are not transferred to or embedded in the primary rotor 14 during operation.

Although the preferred embodiment has been described, it should be understood that various changes, substitutions and alterations can be made therein without departing from the spirit and scope of the invention.

The invention claimed is:

1. A method, comprising:

providing a stator comprising an inner surface and an inner core formed on the inner surface and defining a groove;

removing a primary rotor from the groove;

after removing the primary rotor from the groove, distributing a plurality of nanoparticles within the groove;

after distributing the plurality of nanoparticles within the groove, installing a work rotor into the stator; and rotating the work rotor within the stator such that it presses the nanoparticles into the inner core of the stator.

2. The method of claim 1 further comprising removing the work rotor from the stator after it has pressed the nanoparticles into the inner core of the stator.

3. The method of claim 2 further comprising installing a primary rotor into the stator after the work rotor is removed.

4. The method of claim 1 in which the work rotor is an elongate rod having a square cross-sectional shape.

5. The method of claim 4 in which the work rotor is bent along its length.

6. The method of claim 1 in which the plurality of nanoparticles comprise tungsten disulfide.

7. The method of claim 1 in which the plurality of nanoparticles are characterized by an asymmetric shape a maximum dimension of less than 0.06 nm.

8. The method of claim 1 in which the inner core comprises a polymer material.

9. The method of claim 1 in which the groove is characterized by a series of helical lobes.

10. The method of claim 1 in which the nanoparticles are distributed uniformly within the groove.

11. The method of claim 1 in which the work rotor has a smaller width than the primary rotor.

12. A method of treating a tubular stator having an internal elastomeric substrate within the stator and wherein at least one helical groove is formed in the elastomeric substrate wherein the stator is part of a progressive cavity assembly that includes a mating primary rotor, and further comprising:

removing the primary rotor from the assembly before distributing nanoparticles within the at least one groove; after the nanoparticles have been distributed within the at least one groove, inserting a secondary rotor, differently sized than the primary rotor, into the stator; and rotating the secondary rotor within the stator until the distributed nanoparticles coat the groove; and removing the secondary rotor from the stator after the at least one groove has been coated.

13. The method of claim 12 in which the secondary rotor is an elongate rod having a square cross-sectional shape.

14. The method of claim 12 in which the secondary rotor is bent along its length.

15. The method of claim 12 in which the plurality of nanoparticles comprise tungsten disulfide.

* * * * *